US010946225B2

(12) United States Patent
Broome et al.

(10) Patent No.: US 10,946,225 B2
(45) Date of Patent: Mar. 16, 2021

(54) MODULAR ATTACHMENTS FOR A HANDHELD NOZZLE

(71) Applicant: Akron Brass Company, Wooster, OH (US)

(72) Inventors: L. Michael Broome, Wooster, OH (US); James Habegger, Wooster, OH (US)

(73) Assignee: Akron Brass Company, Wooster, OH (US)

( * ) Notice: Subject to any disclaimer, the term of this patent is extended or adjusted under 35 U.S.C. 154(b) by 0 days.

(21) Appl. No.: 16/164,213

(22) Filed: Oct. 18, 2018

(65) Prior Publication Data

US 2019/0111291 A1 Apr. 18, 2019

Related U.S. Application Data

(60) Provisional application No. 62/573,874, filed on Oct. 18, 2017.

(51) Int. Cl.

| | |
|---|---|
| ***A62C 31/00*** | (2006.01) |
| ***A62C 31/28*** | (2006.01) |
| ***B25G 1/10*** | (2006.01) |
| *A62C 17/00* | (2006.01) |

(52) U.S. Cl.

CPC ..... *A62C 31/005* (2013.01); *A62C 31/28* (2013.01); *B25G 1/102* (2013.01); *A62C 17/00* (2013.01)

(58) Field of Classification Search

CPC ..... A62C 17/00; A62C 31/005; A62C 31/02; A62C 31/03; A62C 31/28; B05B 15/63; B25G 1/00; B25G 1/10; B25G 1/102

USPC .... 239/526; 16/421, 422, 431, 436, DIG. 12

See application file for complete search history.

(56) References Cited

U.S. PATENT DOCUMENTS

| | | | | |
|---|---|---|---|---|
| 5,337,771 | A * | 8/1994 | Berges | A45B 9/02 135/25.4 |
| 6,964,382 | B2 * | 11/2005 | Alexander | B05B 5/025 239/526 |
| D576,253 | S * | 9/2008 | Cheng | D23/223 |
| 7,823,801 | B2 * | 11/2010 | McGarry | A62C 31/02 239/18 |
| 2017/0100616 | A1 * | 4/2017 | Steingass | A62C 31/03 |

* cited by examiner

*Primary Examiner* — Darren W Gorman

(74) *Attorney, Agent, or Firm* — Tucker Ellis LLP; Michael G. Craig

(57) ABSTRACT

A modular system is disclosed for handheld nozzles to facilitate distinguishing various nozzles in terms of nozzle type, owner, or type of fluid. Modular attachments are removably coupled to handles of the nozzles to provide the distinguishing characteristics. The modular attachment are secured to the handles without the use of mechanical fasteners or adhesives, and, instead, utilize integral mechanical attachment methods. The modular attachments can be made in a variety of colors to enable color-coding the distinguishing characteristics.

17 Claims, 13 Drawing Sheets

MODULAR ATTACHMENTS FOR A HANDHELD NOZZLE

RELATED APPLICATIONS

This application claims priority to U.S. Ser. No. 62/573,874, entitled MODULAR ATTACHMENTS FOR A HANDHELD NOZZLE, filed Oct. 18, 2017, which is incorporated herein by reference.

BACKGROUND

Nozzles are devices configured to control direction or other characteristics of a fluid flow entering an inlet and/or existing an outlet of a nozzle. For example, nozzles can be employed to alter a rate of flow, a velocity, direction, mass, shape, and/or pressure of an emergent stream. Some nozzles are designed for a particular application such as being configured for mechanical attachment to a particular source or adapted for use with a particular fluid. High-end nozzles, however, can offer versatility in terms of employment with a variety of fluids or for a variety of purposes.

SUMMARY

A simplified summary is provided herein to help enable a basic or general understanding of various aspects of exemplary, non-limiting implementations that follow in the more detailed descriptions and the accompanying drawings. This summary is not intended, however, as an extensive or exhaustive overview. Instead, the sole purpose of the summary is to present some concepts related to some exemplary non-limiting implementations in a simplified form as a prelude to the more detailed description of the various implementations that follow.

In various, non-limiting implementations, a modular attachment system can be configured to provide removable attachments for handheld nozzles to designate or identify nozzle type, nozzle owner, fluid type, or other characteristics of the nozzles. The removable attachments can be securely coupled to the nozzles, for example on handles thereof, to provide desired designations. In one implementation, the removable attachments are affixed to the nozzles without mechanical fasteners or adhesives. For instance, the removable attachments can be secured via friction and/or pressure provided through internal resilience.

In one implementation, a modular attachment system for a handheld firefighting nozzle can comprise a pistol grip module that is shaped for attachment to, and to cover at least a portion of, a pistol grip handle of the handheld nozzle. Further, the modular attachment system can comprise a bale handle module that is shaped for attachment to, and to cover at least a portion of, a bale handle of the handheld nozzle. Additionally, in the modular attachment system the pistol grip module and bale handle module can engage with the pistol grip handle and the bale handle, respectively, using an integral mechanical attachment. In this implementation, the pistol grip module and bale handle module can respectively comprise a same color coding to visually indicate a particular characteristic associated with the handheld nozzle.

To the accomplishment of the foregoing and related ends, the following description and annexed drawings set forth certain illustrative aspects and implementations. These are indicative of but a few of the various ways in which one or more aspects may be employed. Other aspects, advantages and novel features of the disclosure will become apparent from the following detailed description when considered in conjunction with the annexed drawings.

BRIEF DESCRIPTION OF THE DRAWINGS

FIGS. 7A, 7B, 7C, 7D illustrate an alternate exemplary, non-limiting implementation of a pistol grip assembly for a handheld nozzle.

DETAILED DESCRIPTION

Figure 1:
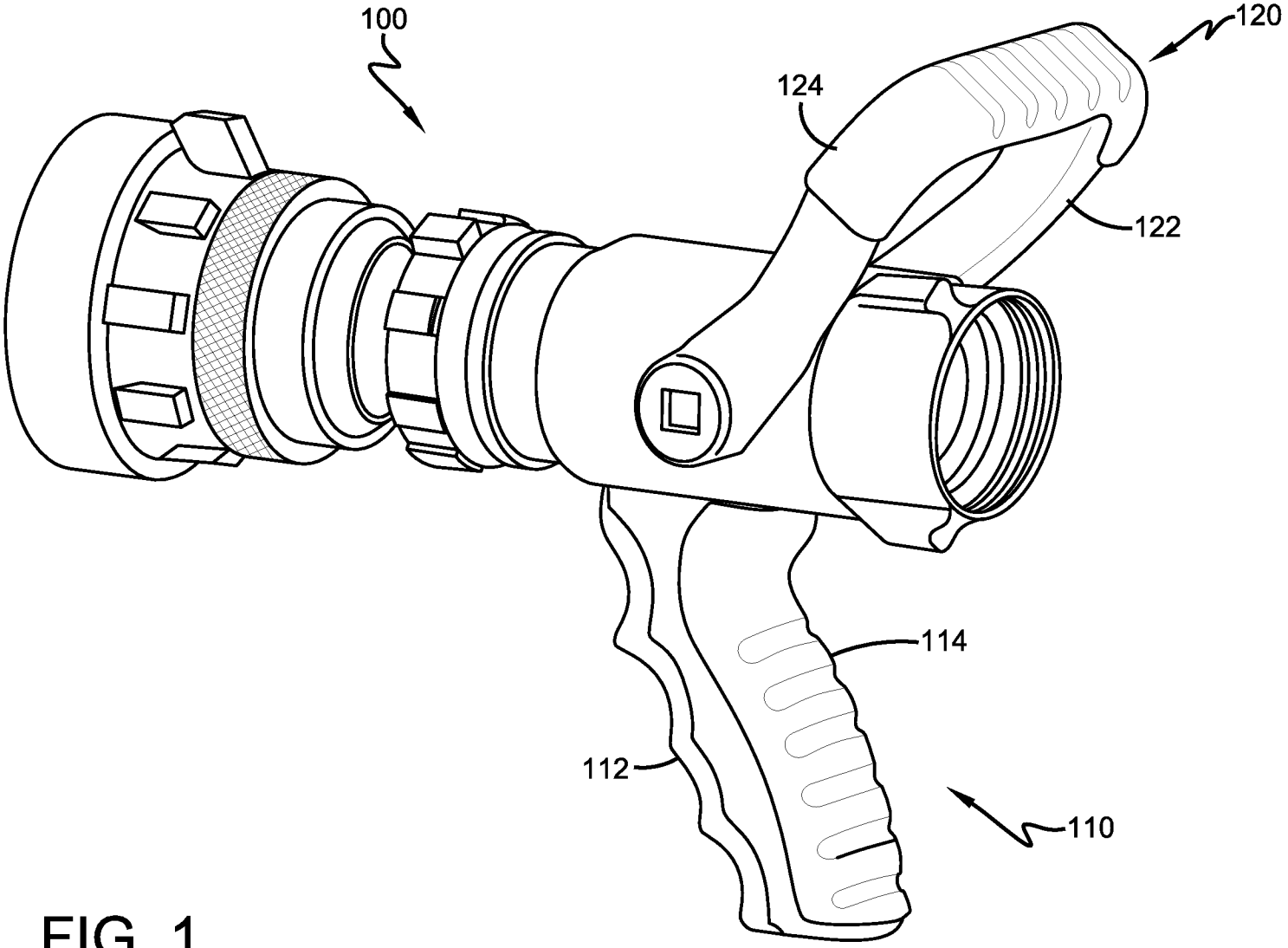
FIG. 1 illustrates an exemplary, non-limiting implementation of a handheld nozzle in accordance with various aspects.

The claimed subject matter is now described with reference to the drawings, wherein like reference numerals are generally used to refer to like elements throughout. In the following description, for purposes of explanation, numerous specific details are set forth in order to provide a thorough understanding of the claimed subject matter. It may be evident, however, that the claimed subject matter may be practiced without these specific details. In other instances, structures and devices are shown in block diagram form in order to facilitate describing the claimed subject matter.

As described above, fluid distribution nozzles, such as handheld nozzles used for firefighting applications, can comprise different types for different uses, have different owners, or control different types of fluid. For example, firefighting nozzles can be used to control various extinguishing agents such as a water or foam, which, in turn, may involve utilizing different nozzles types or shapes to adequately direct the corresponding agent. To distinguish different nozzles configurations or designations for particular uses, modular attachments can be employed to provide easily distinguishable, visual indications of the corresponding configurations or designations.

In accordance with one or more aspects, a modular attachment system can be devised to provide removable attachments for handheld nozzles, for example, to designate or identify nozzle type, nozzle owner, fluid type, or other characteristics of the nozzles. That is, for example, the removable attachment modules can be color coded to provide visual identification and distinction between nozzles. In one implementation, the removable attachments can be securely coupled to the nozzles, for example, on handles thereof, to provide the desired designations. In one implementation, the removable attachments can be affixed to the nozzles without mechanical fasteners or adhesives. For example, the removable attachments can be secured using a friction fit and/or a pressure fit provided through internal resilience of the modules.

In one implementation, the removable attachments can be colored to indicate different designations, uses, or other characteristics. Further, the removable attachments can bear labels. Such labels can be integrally formed with the attachments (e.g., the label is seamlessly formed as part of the attachment as a monolithic piece) or the attachment can be provide a surface or other mounting features with which to attach the labels. In addition, the removable attachments can be designed, shaped or otherwise configured for a particular user to provide a form-fit to the user's hand or use. Still further, the removable attachments can bear various ornamental designs, customizations (e.g. personalization), or other non-essential features (e.g., massaging nubs or the like).

Referring now to the figures, FIG. 1 illustrates an exemplary, non-limiting implementation of a handheld nozzle on which various aspects of a modular attachment system are implemented. As shown in FIG. 1, in one implementation, a nozzle 100 for controlling a fluid flow (e.g., firefighting nozzle) comprises a pistol grip assembly 110 to facilitate holding and maintaining control of the nozzle by a user during operation. In addition, nozzle 100 can include a bale handle assembly 120 for controlling a flow rate of a fluid through nozzle 100. For example, the bale handle assembly 120 is operable to turn off a flow of fluid through the nozzle 100, turn on the flow of fluid, or establish a selectably variable flow of fluid through the nozzle 100.

In FIG. 1, in this implementation, the pistol grip assembly 110 can comprise a pistol grip handle 112 with a modular pistol grip attachment 114 coupled thereto. Similarly, the bale handle assembly 120 comprises a bale handle 122 having a modular bale handle attachment 124 attached. In one implementation, the modular attachments 114, 124 can comprise various colors as visual indicators, ornamental features, customizations, or other distinguishing features for nozzle 100. For example, the modular attachments 114, 124 can be color coded to indicate a nozzle type, an owner, or a type of fluid to be conveyed through the nozzle 100, amongst other things.

According to an aspect, the modular attachments 114, 124 can be formed from a material having some resilience so to be capable of maintaining or restoring shape following temporary deformations. For example, the modular attachment 114, 124 can be made of polymer materials which provide a high strength-to-weight ratio. Suitable materials can include, but are not limited to, polyamide, polycarbonate, polyester, polyethylene (e.g., high density polyethylene, low density polyethylene, polyethylene terephthalate), polypropylene, polystyrene, polyurethane, polyvinyl chloride, acrylonitrile butadiene styrene (ABS), phenolics, melamine formaldehyde, polyether ether ketone (PEEK), maleimide, polyimide, silicone, acrylics, or substantially any other plastic or thermoplastic material capable of attachment to nozzle handles. It is to be appreciated, however, that the modular attachments 114, 124 can be formed from metal. Further, the modular attachments 114, 124 can be molded or created through additive manufacturing (e.g., 3D printing).

Figure 3:
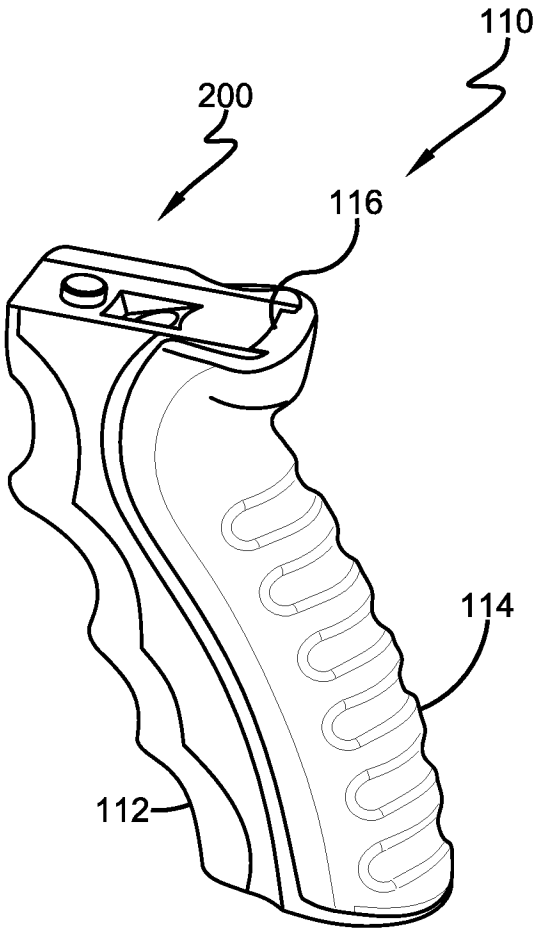
FIGS. 2, 3, and 4 illustrate an exemplary, non-limiting implementation of a pistol grip assembly for a handheld nozzle.
Figure 2:
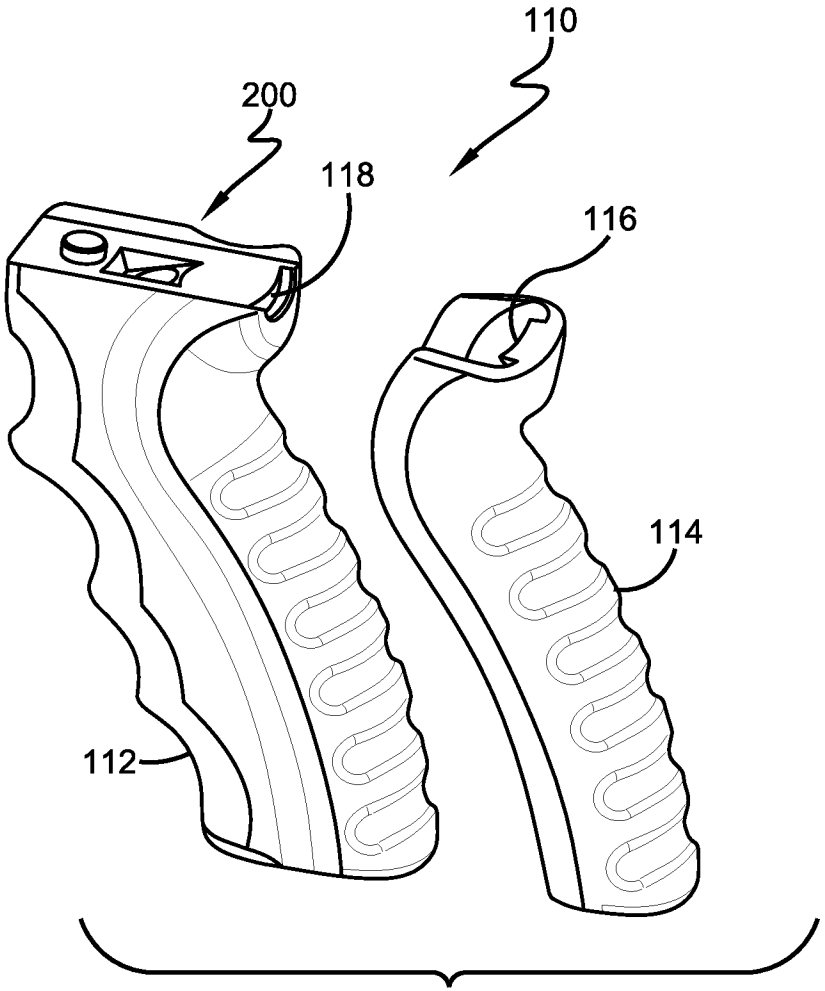
Figure 4:
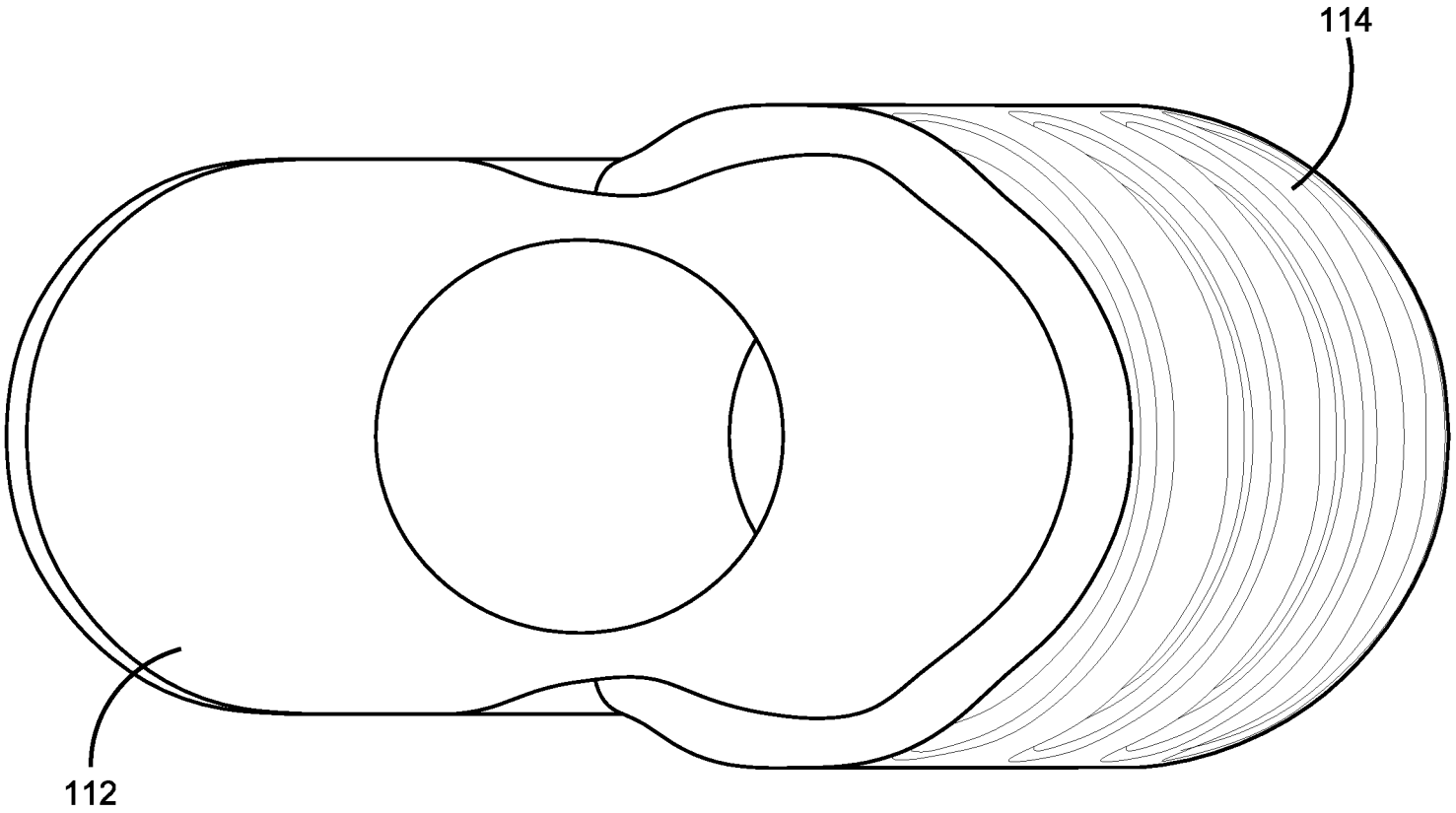

FIGS. 2 and 3 illustrates an exemplary, non-limiting implementation of pistol grip assembly 110 according to various aspects. In particular, FIG. 2 depicts an example nozzle pistol grip handle 112 apart from the pistol grip module attachment 114; and FIG. 3 depicts the two components coupled together. FIG. 4 depicts a cross-sectional view of the nozzle pistol grip 112 with the pistol grip module attachment 114 joined thereto. In one implementation, the pistol grip handle 112 may comprise one or more means 200, used to attach the pistol grip handle 112 to nozzle 100 as shown in FIG. 1. Further, the pistol grip handle 112 can comprise one or more attachment components 118, such as a recess, that are configured to receive an integrated connector 116, such as a tab, of the modular pistol grip attachment 114, to facilitate alignment and securing of the grip modular attachment 114 to the pistol handle 112. In one implementation, the integral mechanical attachment 116 of the pistol grip module 114 can comprises an integral connector that fits into a complementary recess 118 in the nozzle pistol grip 112 to facilitate alignment of the pistol grip module 114 with the nozzle pistol grip 112, and to dispose the pistol grip module 114 in a fixed engagement with the nozzle pistol grip 112.

According to one implementation, the grip modular attachment 114 can having an outer surface that generally replicates an outer surface of the pistol grip 112, so as to provide a similar grip and feel as the pistol grip 112 without the grip modular attachment 114. Further, an inner surface of the grip modular attachment 114 can be complementary (e.g., generally conform) to the outer surface of the pistol grip 112 to facilitate secure attachment. It is to be appreciated, in some examples, the outer surface of the grip modular attachment 114 can differ from the outer surface of the pistol grip 112 so as to provide different grip styles or enhancements.

In one implementation, the grip modular attachment 114 can couple to the nozzle pistol grip 112 without the use of mechanical fasteners (i.e. screws, bolts, etc.) or adhesives. In this implementation, without fasteners or adhesives may provide for a secure attachment while also facilitating easier removal. According to an example, the grip modular attachment 114 can snap-fit to pistol grip 112. That is, the grip modular attachment 114 can elastically deform sufficiently to accept the pistol grip 112 and wrap around at least a portion therefor (see FIG. 4). The grip modular attachment 114 can have a sufficient resiliency to restore shape following deformation so as to securely hold to the pistol grip 112 and resist unintentional removal. In one implementation, the pistol grip module 114 can comprise a material resilience that appropriately deforms during attachment, and appropriately reform upon attachment.

Figure 4A:
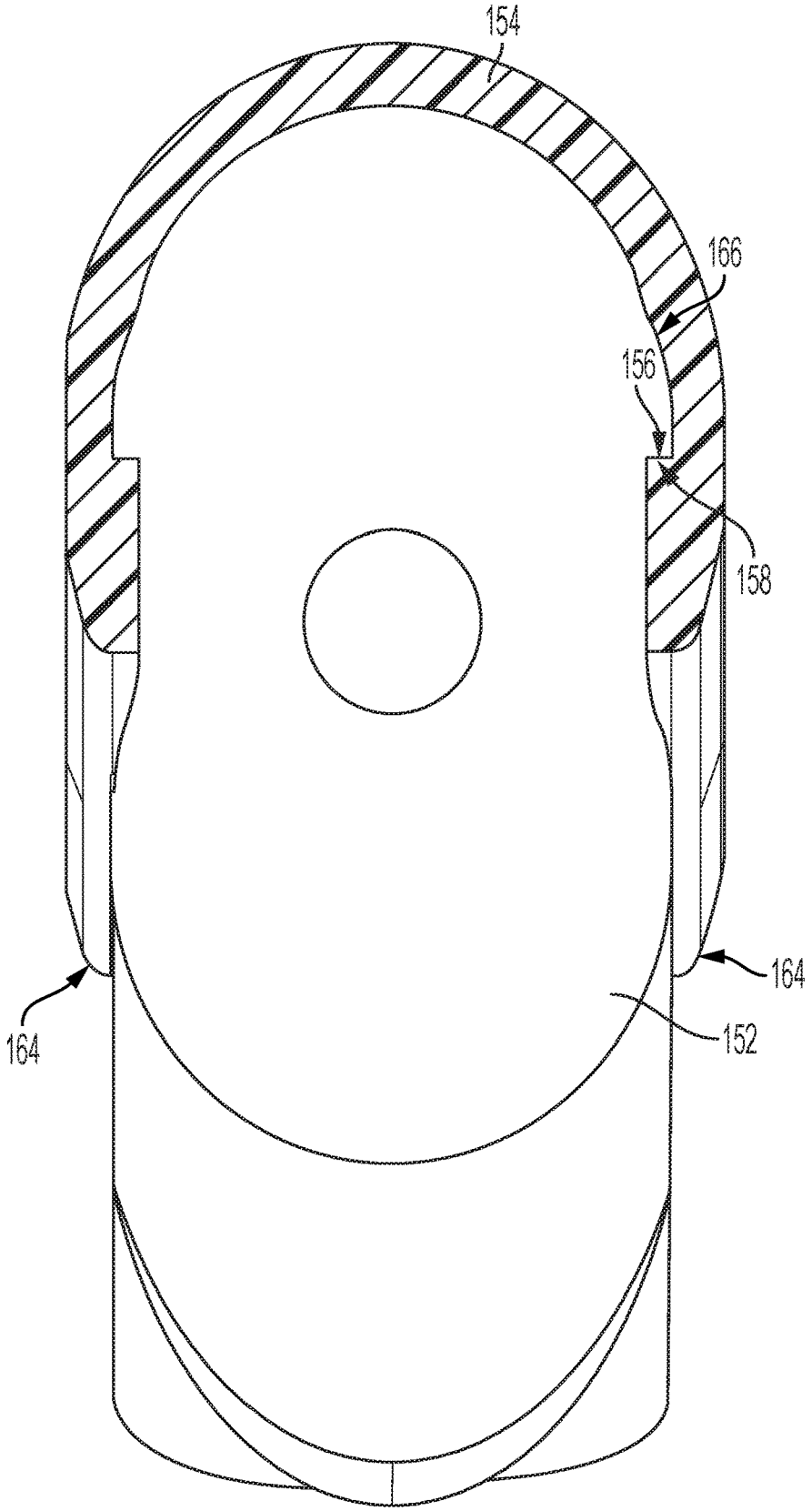
FIGS. 4A, 4B, 4C, 4D illustrate an alternate exemplary, non-limiting implementation of a pistol grip assembly for a handheld nozzle.
Figure 4B:
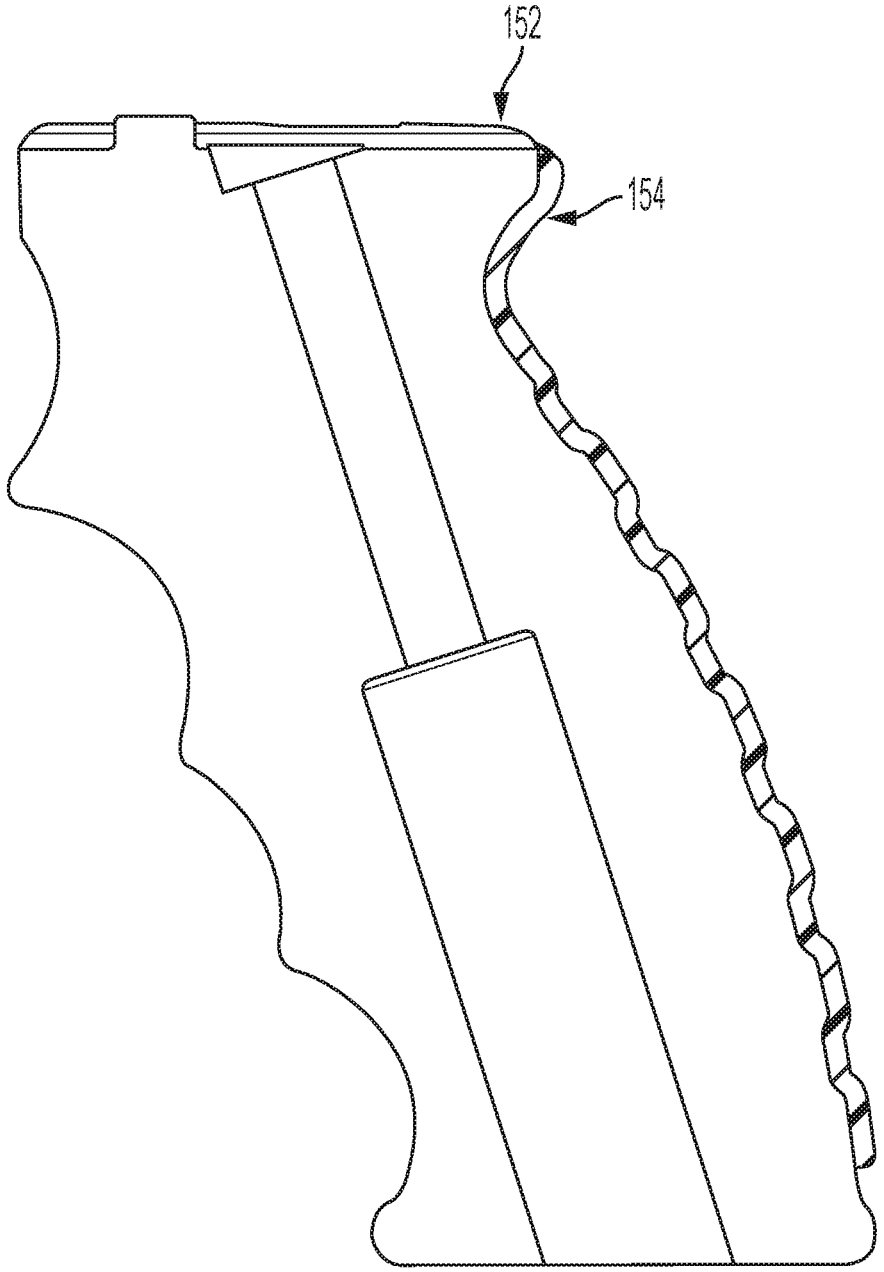
Figure 4C:
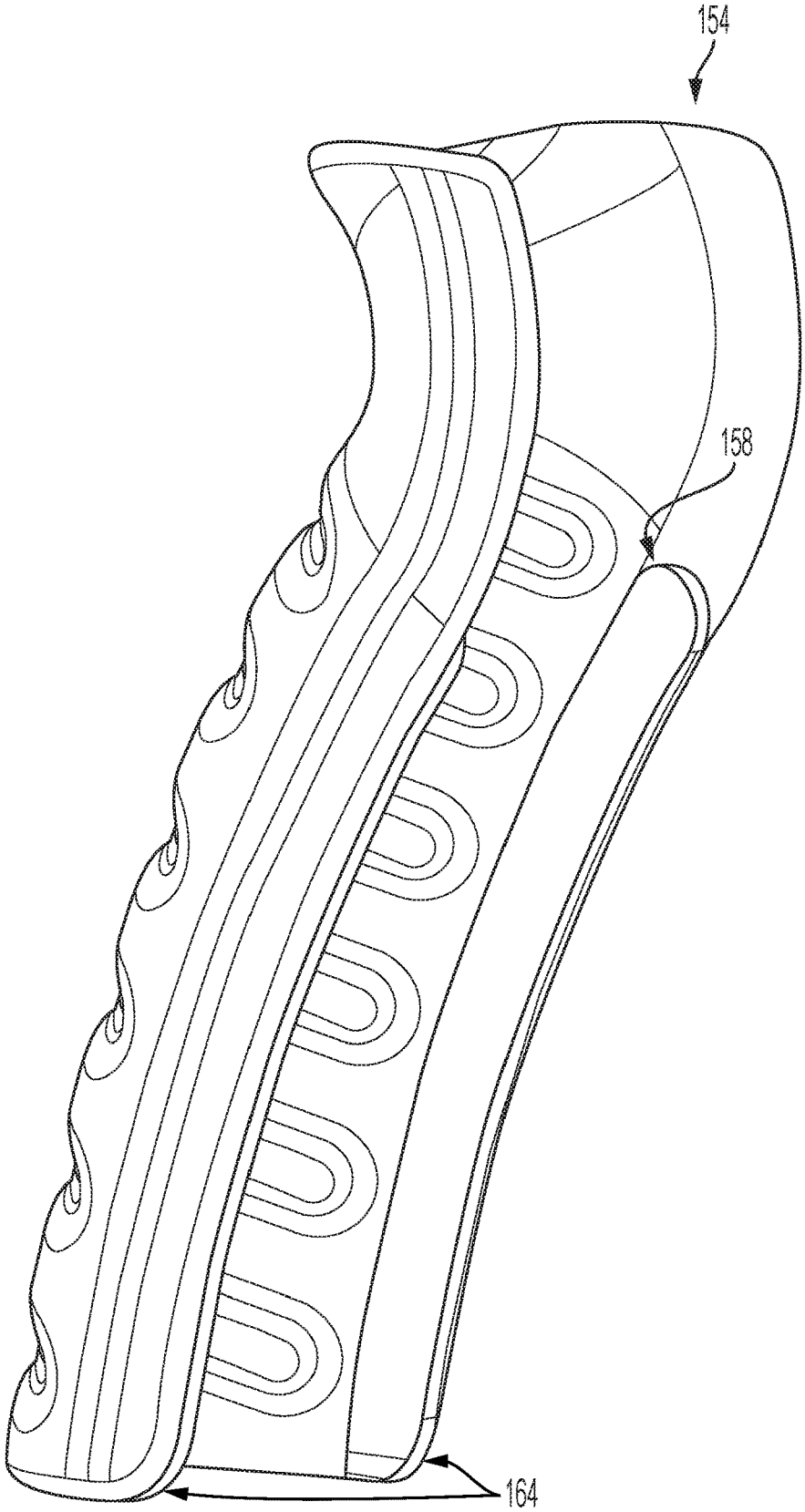
Figure 4D:
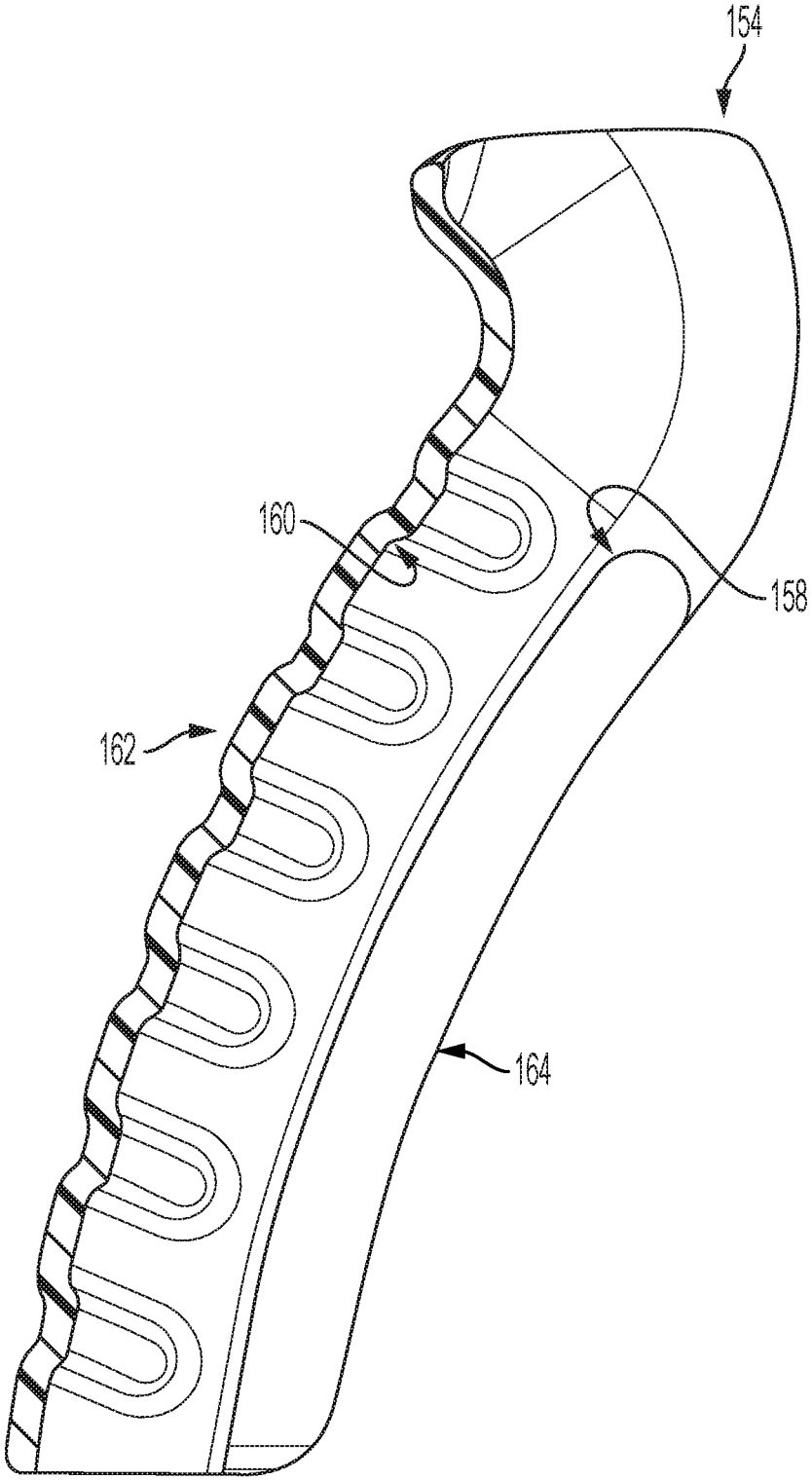

FIGS. 4A-4D are component diagrams illustrating an example alternate implementation of a pistol grip assembly. FIG. 4A depicts a cross-section of a nozzle pistol grip 152, with an attached pistol grip module 154; FIG. 4B depicts a longitudinal cut-away of the nozzle pistol grip 152, with the attached pistol grip module 154; FIG. 4C depicts a perspective view of the pistol grip module 154; and FIG. 4D depicts a longitudinal cut-away of the pistol grip module 154. In this implementation, the pistol grip module 154 can comprise a lip 158 that is disposed at an end of respective sidewalls 164 of the pistol grip module 154. In this implementation, the lip 158 can be shaped to engage a recess 156 disposed adjacent to a shoulder 166 in the pistol grip 152 to dispose the pistol grip module 154 in a fixed engagement with the nozzle pistol grip 152.

In one implementation, an outer surface of the pistol grip module comprising raised nodes 162 to provide grip to a user of the nozzle. In another implementation, the outer surface 162 of the pistol grip module 154 comprising customized surface grip features to fit a target user's hand. In another implementation, the outer surface 162 of the pistol grip module 154 can comprise a label formed into the outer surface or a feature for attaching a label on the outer surface. Further, an inner surface 160 of the pistol grip module 154 can generally conform to the outer surface of the pistol grip handle 152 to facilitate secure attachment.

Figure 5:
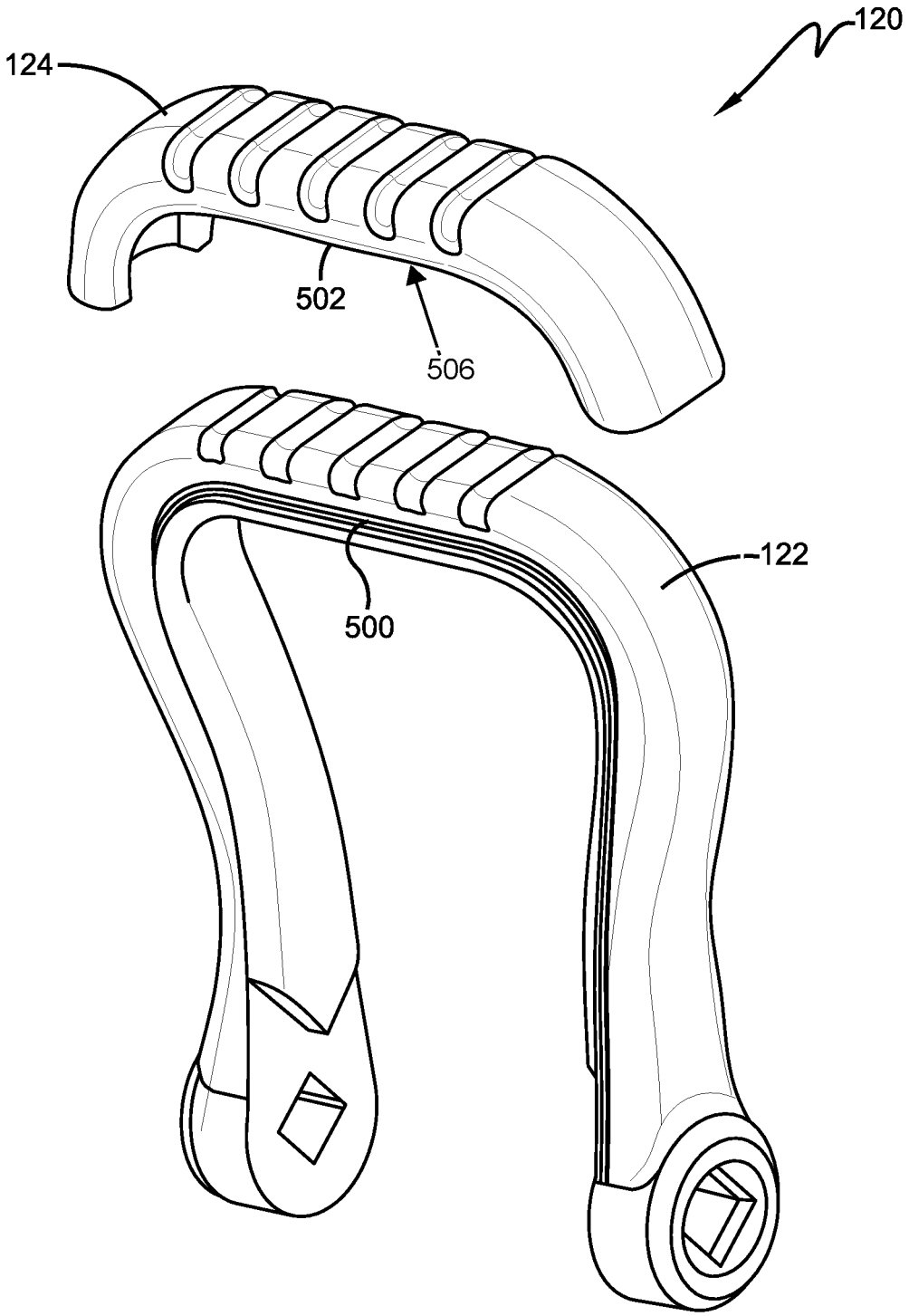
FIGS. 5, 6, and 7 illustrate an exemplary, non-limiting implementation of a bale handle in according to one or more aspects.
Figure 6:
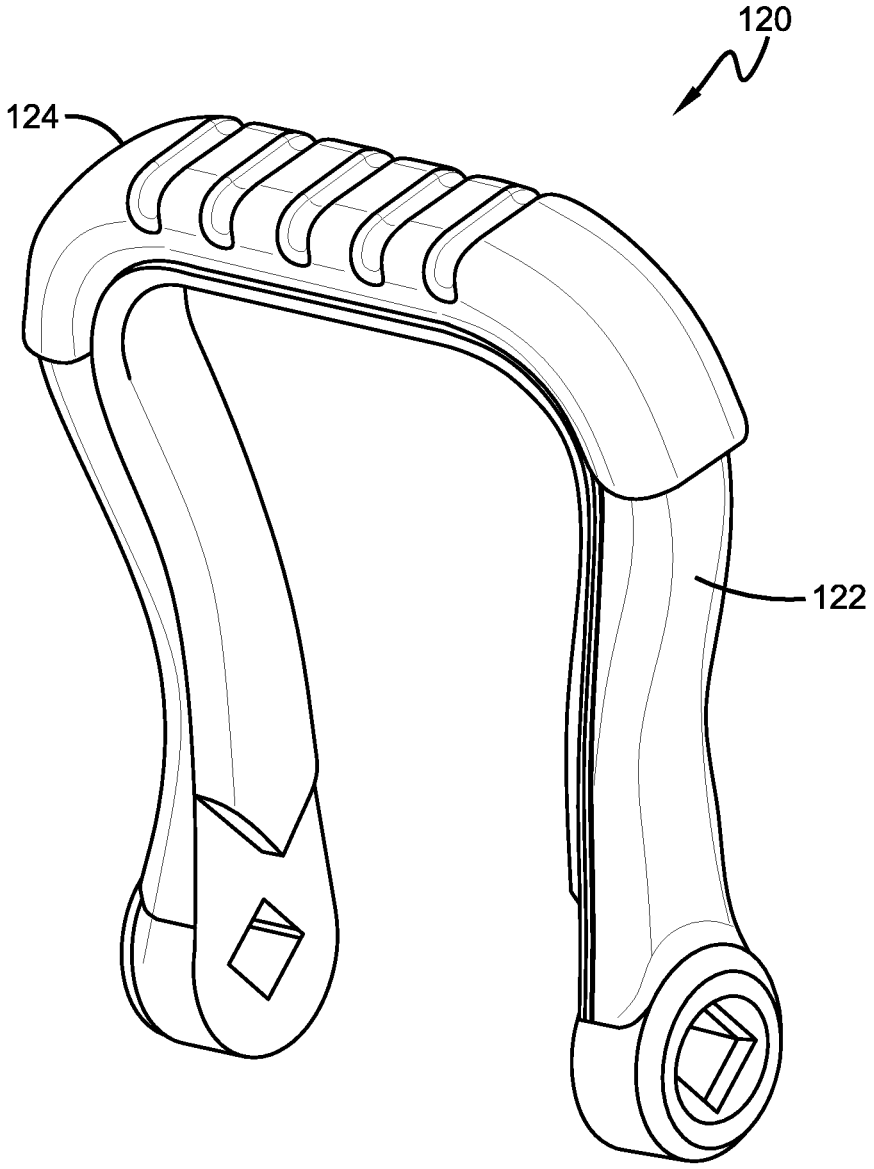
Figure 7:
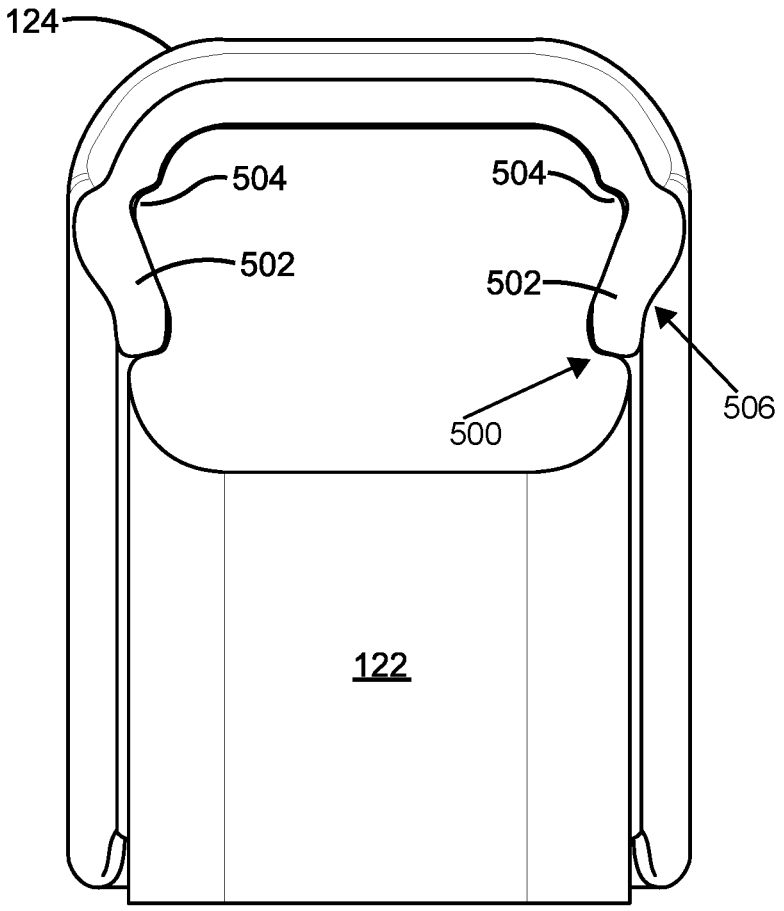

FIG. 5-7 illustrates an exemplary, non-limiting implementation of bale handle assembly 120 according to various aspects. In particular, FIG. 5 depicts the bale handle 122 without the bale handle attachment 124 coupled thereto. FIG. 6 depicts the bale handle 122 with attachment 124 securely attached thereto. FIG. 7 is a partial cross-sectional view of the bale handle 122 with the attachment 124 coupled.

As with the pistol grip attachment 114 described above, the bale handle modular attachment 124 (bale handle module) can have an outer surface generally replicating an outer surface of the bale handle 122 so as to provide a similar grip and feel as the bale handle 122. Further, an inner surface of the modular attachment 124 can generally conform to the outer surface of the bale handle 122 to facilitate secure attachment. It is to be appreciated, however, that the outer surface of the modular attachment 124 can differ from the outer surface of the bale handle 112 so as to provide different grip styles or enhancements. Further, as with the pistol grip attachment 114, the modular attachment 124 attaches to the bale handle 122 without the use of mechanical fasteners or adhesives.

As shown in FIGS. 5 and 7 in particular, the bale handle 122 can comprise a groove or recess 500 that may be configured to receive a corresponding lip portion 502 of the sidewalls 506 of the modular bale handle attachment 124 to facilitate a secure coupling. Moreover, according to an example, the bale handle 122 can include shoulder portions 504 (FIG. 7) that are configured to facilitate attachment of the modular attachment 124. For example, the shoulder portions 504 can operate to deflect (i.e. deform) the sidewalls 506 of the modular attachment 124 outward when the lip portions 502 engage thereto during installation of the modular attachment 124. The deflection enables the modular attachment 124 to slide over the bale handle 122. The resiliency provided by the material of the modular attachment 124 enables the sidewalls 156 to return to a non-deformed state upon sliding past the shoulder portions 504 so as to the engage the lip portions 502 with the groove or recess 500 to securely hold the modular attachment 124 to the bale handle 122.

Figure 7A:
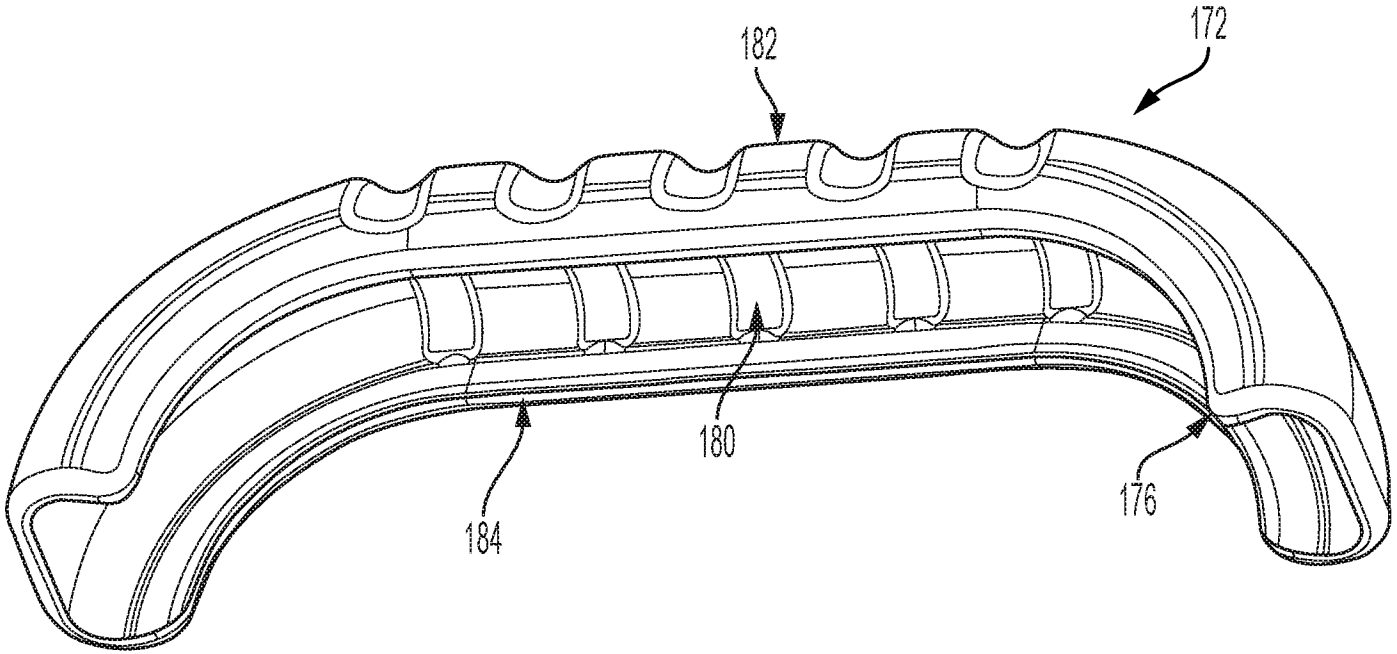
Figure 7B:
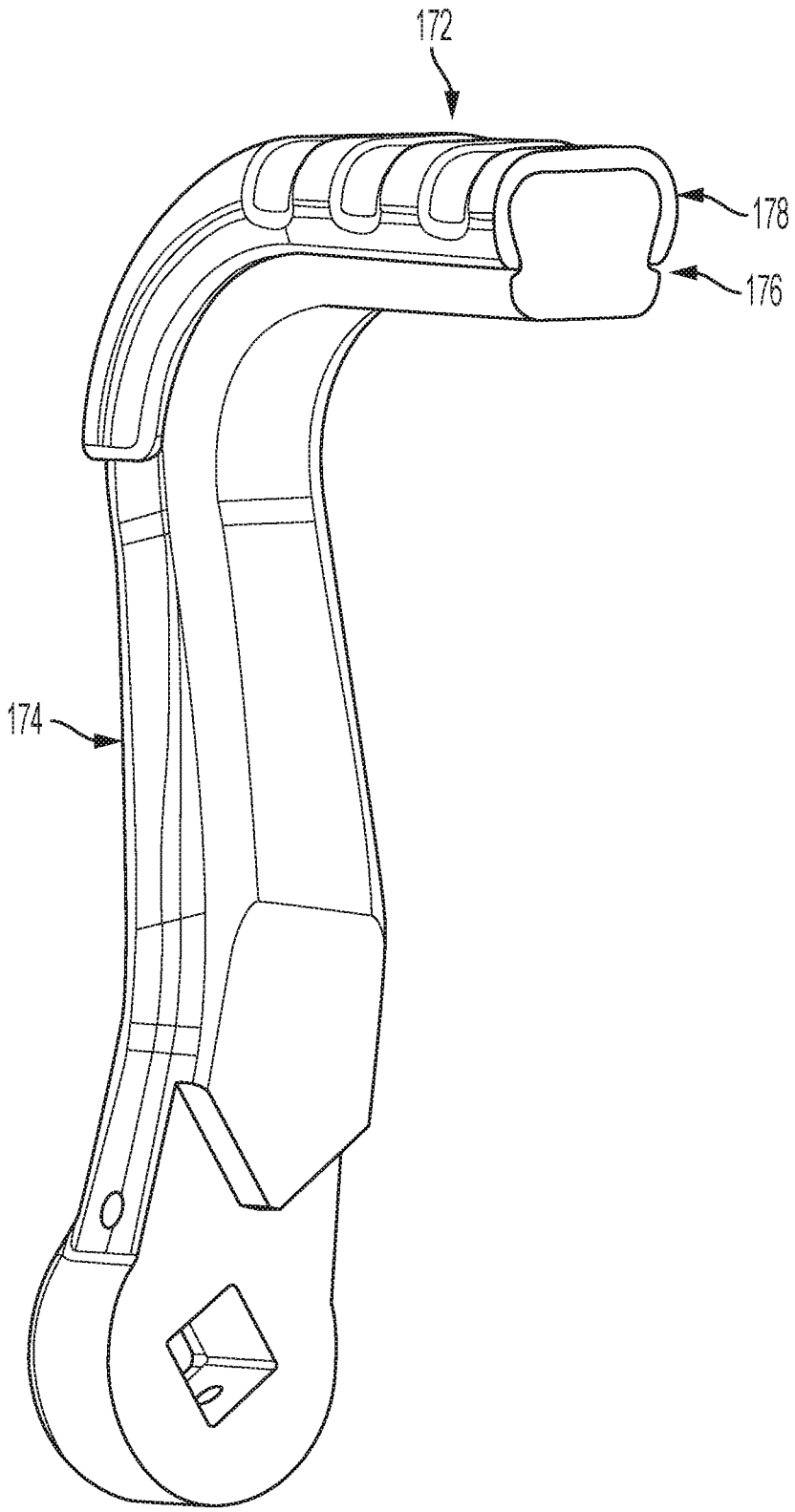

FIGS. 7A and 7B illustrate an alternate implementation of a bale handle assembly (e.g., 120). In this implementation, a bale handle module 172 can comprise an inner surface 180 that is complementary to an outer surface of the nozzle bale handle 174, in order to be substantially form fitting when attached to the nozzle bale handle 174. Further, the outer surface 182 of the bale handle module 172 can comprise raised nodes or user customizations to provide improved grip the user of the nozzle. Additionally, in one implementation, the bale handle module 172 can comprise sidewalls 184, which respectively comprising a lip 176. In this implementation, the sidewalls 184 can deflect outward during attachment to the bale handle 174, as a result of a shoulder 178 of the nozzle bale handle 174 driving the lips 176 apart, resulting in the bale handle module 172 disposed in a fixed engagement with the nozzle bale handle 174 upon the lips 176 of the sidewall 184 clearing the shoulder 178 of the nozzle bale handle 174.

Figure 8:
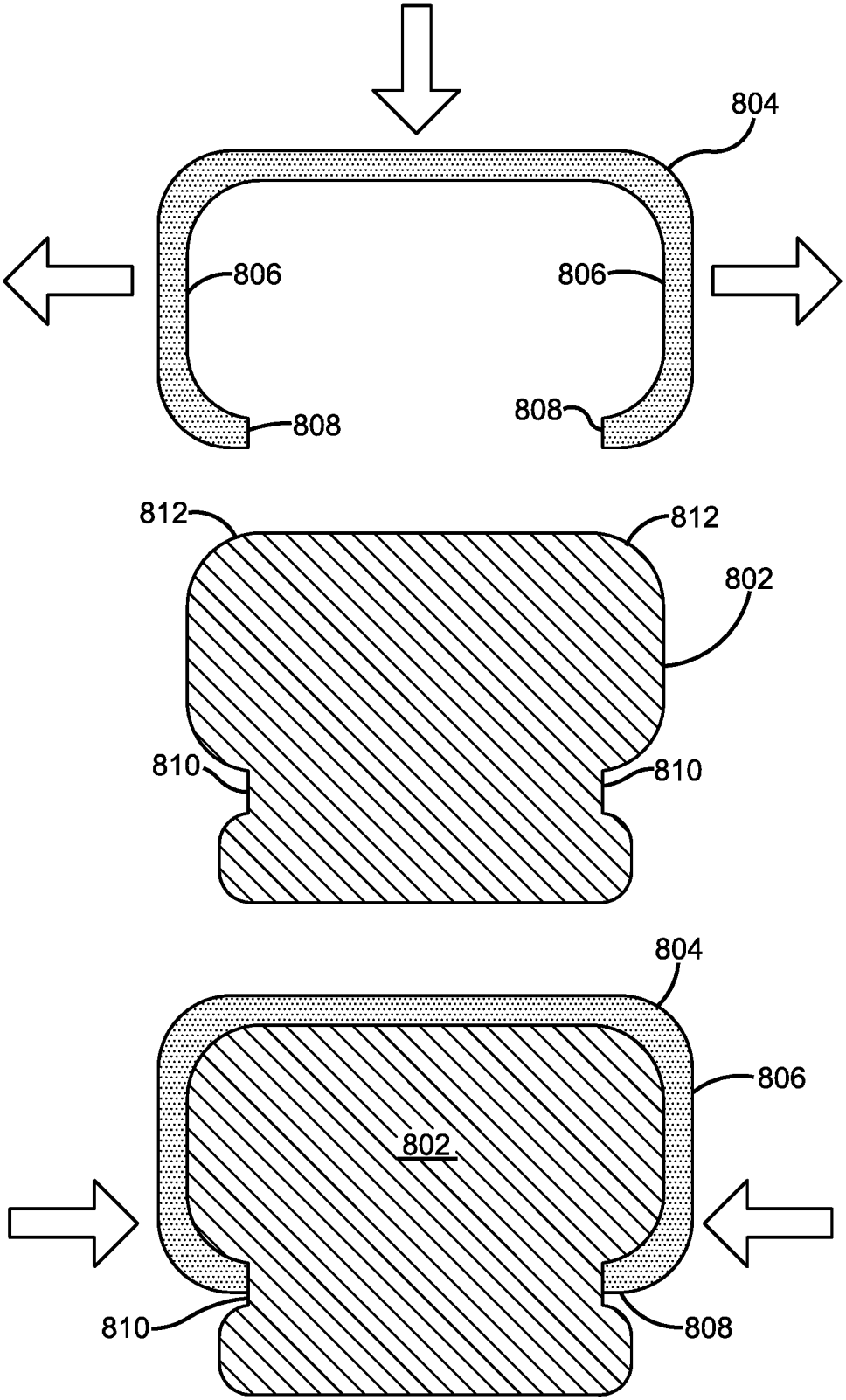
FIG. 8 illustrates an exemplary, non-limiting implementation of a modular attachment for a handle suitable for employment with handheld nozzles described herein.

Turning briefly to FIG. 8, an illustration of an exemplary, non-limiting attachment mechanism is depicted. As shown in FIG. 8, cross-sectional views of a handle 802 and a module 804 are illustrated. The handle 802 can be the pistol grip handle 112 or bale handle 122, for example. Likewise, module 804 can be the pistol grip attachment 114 or bale handle attachment 124.

The module 804 includes a pair of sidewalls 806 terminating at respective lip portions 808. The handle 802 includes a groove or recess 810 and a pair of shoulders or ramp portions 812. According to an aspect, to attach the module 804 to the handle 802, a downward force exerted on the module 804 while the lip portions 808 are engaged with the shoulders 812 results in an outward deflection of the sidewalls 806. The shoulders 812 operate as ramps to push the lip portions 808 and enable the lip portions 808 to slide past the shoulders 812 and long the outer surface of the handle 802. As the downward force continues to enable the module 804 to slidably wrap the handle 802, the lip portions 808 eventually reach the groove or recess 810, which enables the module 804 to return to a non-deformed state.

In one implementation of a modular attachment system for a handheld firefighting nozzle, a pistol grip module 114, 154 can be shaped for attachment to, and to cover at least a portion of, a pistol grip handle 112,152 of the handheld nozzle 100. Further, in this implementation, a bale handle module 124 can be shaped for attachment to, and to cover at least a portion of, a bale handle 122 of the handheld nozzle 100. In this implementation, the pistol grip module 114,154 and bale handle module 124 can engage with the pistol grip handle 112,152 and the bale handle 122, respectively, using an integral mechanical attachment (e.g., 116, 164, 158), and respectively comprise a same color coding to visually indicate a particular characteristic associated with the handheld nozzle 100.

In another implementation, a handheld nozzle can comprise a fluid dispensing nozzle (e.g., 100) to control a fluid flow. Further, the handheld nozzle can comprise a pistol grip assembly (e.g., 110) removably engaged to the nozzle. In this implementation, the pistol grip assembly can comprise a pistol grip handle (e.g., 112, 152), and a modular pistol grip attachment 114, 154). The modular pistol grip attachment can be removably engaged with the pistol grip handle using an integral mechanical attachment (e.g., 118, 158, 164). The handheld nozzle can comprise a bale handle assembly (e.g., 120) that is engaged with the nozzle device. The bale handle assembly can comprise a bale handle (e.g., 122, 174), and a modular bale handle attachment (124, 172). The modular bale handle attachment can be removably engaged with the bale handle using an integral mechanical attachment (e.g., 502, 506, 176, 184). In this implementation, the module pistol grip attachment and the modular bale handle attachment can be color-coded to indicate a particular characteristic associated with the handheld nozzle.

In one implementation, a method of making a modular attachment system for a handheld firefighting nozzle can comprise forming a pistol grip module. The pistol grip module can be shaped for attachment to, and to cover at least a portion of, a pistol grip handle of the handheld nozzle. Further, the method of making a modular attachment system can comprise forming a bale handle module that is shaped for attachment to, and to cover at least a portion of, a bale handle of the handheld firefighting nozzle. In this implementation, the pistol grip module and bale handle module can be formed to engage with the pistol grip handle and the bale handle, respectively, using an integral mechanical attachment. Further, the pistol grip module and bale handle module can be formed to respectively comprise a same color coding to visually indicate a particular characteristic associated with the handheld firefighting nozzle.

In one implementation, the method of making a modular attachment system for a handheld firefighting nozzle can comprise forming the pistol grip module with the integral mechanical attachment that comprise forming an integral connector that fits into a complementary recess in the nozzle pistol grip to facilitate alignment of the pistol grip module with the nozzle pistol grip, and to dispose the pistol grip module in a fixed engagement with the nozzle pistol grip.

Further, the method of making a modular attachment system can comprise forming of the bale handle module with the integral mechanical attachment comprising forming an integral connector that fits into a complementary recess in the bale handle to facilitate alignment of the bale handle module with the bale handle, and to dispose the bale handle module in a fixed engagement with the bale handle.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims. It is to be appreciated that various features or aspects of the implementations described herein can be utilized in any combination with any of the other implementations.

As utilized herein, the term "or" is intended to mean an inclusive "or" rather than an exclusive "or." That is, unless specified otherwise, or clear from the context, the phrase "X employs A or B" is intended to mean any of the natural inclusive permutations. That is, the phrase "X employs A or B" is satisfied by any of the following instances: X employs A; X employs B; or X employs both A and B. In addition, the articles "a" and "an" as used in this application and the appended claims should generally be construed to mean "one or more" unless specified otherwise or clear from the context to be directed to a singular form. Further, as used herein, the term "exemplary" is intended to mean "serving as an illustration or example of something."

Furthermore, the claimed subject matter may be implemented as a method, apparatus or article of manufacture using standard programming and/or engineering techniques to produce software, firmware, hardware or any combination thereof to control a computer to implement the disclosed subject matter. The term "article of manufacture" as used herein is intended to encompass a computer program accessible from any computer-readable device, carrier or media. Of course, those skilled in the art will recognize many modifications may be made to this configuration without departing from the scope or spirit of the claimed subject matter.

Also, although the disclosure has been shown and described with respect to one or more implementations, equivalent alterations and modifications will occur to others skilled in the art based upon a reading and understanding of this specification and the annexed drawings. The disclosure includes all such modifications and alterations and is limited only by the scope of the following claims. In particular regard to the various functions performed by the above described components (e.g., elements, resources, etc.), the terms used to describe such components are intended to correspond, unless otherwise indicated, to any component which performs the specified function of the described component (e.g., that is functionally equivalent), even though not structurally equivalent to the disclosed structure which performs the function in the herein illustrated exemplary implementations of the disclosure. In addition, while a particular feature of the disclosure may have been disclosed with respect to only one of several implementations, such feature may be combined with one or more other features of the other implementations as may be desired and advantageous for any given or particular application. Furthermore, to the extent that the terms "includes," "having," "has," "with," or variants thereof are used in either the detailed description or the claims, such terms are intended to be inclusive in a manner similar to the term "comprising."

The implementations have been described, hereinabove. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof.

What is claimed is:

1. A modular attachment system for a handheld firefighting nozzle, comprising:

a pistol grip module shaped for removable attachment to, and to cover at least a portion of, a pistol grip handle of the handheld nozzle, wherein the pistol grip module comprises an inner surface that is complementary to a grip pattern on an outer surface of the pistol grip handle to be substantially form fitting when attached to the pistol grip handle; and a bale handle module shaped for removable attachment to, and to cover at least a portion of, a bale handle of the handheld nozzle, wherein the bale handle module comprises an inner surface that is complementary to a grip on an outer surface of the bale handle to be substantially form fitting when attached to the bale handle;

wherein the pistol grip module and bale handle module engage with the pistol grip handle and the bale handle, respectively, using an integral mechanical attachment, and respectively comprise a same color coding to visually indicate a particular characteristic associated with the handheld nozzle.

2. The system of claim 1, the pistol grip module and the bale handle module comprising material resilience to appropriately deform during attachment and to appropriately reform upon attachment.

3. The system of claim 1, the integral mechanical attachment of the pistol grip module comprising an integral connector that fits into a complementary recess in the nozzle pistol grip to facilitate alignment of the pistol grip module with the nozzle pistol grip, and to dispose the pistol grip module in a fixed engagement with the nozzle pistol grip.

4. The system of claim 1, the integral mechanical attachment of the bale handle module comprising an integral connector that fits into a complementary recess in the nozzle bale handle to facilitate alignment of the bale handle module with the nozzle bale handle, and to dispose the bale handle module in a fixed engagement with the nozzle bale handle.

5. The system of claim 1, the bale handle module comprising sidewalls, respectively comprising a lip, such that the sidewalls deflect outward during attachment as a result of a shoulder of the nozzle bale handle driving the lips apart, resulting in the bale handle module disposed in a fixed engagement with the nozzle bale handle upon the lips of the sidewall clearing the shoulder of the nozzle bale handle.

6. The system of claim 1, the pistol grip module comprising a lip disposed at an end of respective sidewalls of the pistol grip module, the lip shaped to engage a recess disposed adjacent to a shoulder in the nozzle pistol grip to dispose the pistol grip module in a fixed engagement with the nozzle pistol grip.

7. The system of claim 1, an outer surface of the pistol grip module comprising raised nodes to provide grip to a user of the nozzle.

8. The system of claim 1, an outer surface of the bale handle module comprising raised nodes to provide grip to a user of the nozzle.

9. The system of claim 1, an outer surface of the pistol grip module comprising customized surface grip features to fit a target user's hand.

10. A handheld nozzle, comprising:

a fluid dispensing nozzle to control a fluid flow;

a pistol grip assembly removably engaged to the nozzle, the pistol grip assembly comprising:

a pistol grip handle; and a modular pistol grip attachment removably engaged with the pistol grip handle using an integral mechanical attachment, wherein the modular pistol grip attachment comprises an inner surface that is complementary to a grip on an outer surface of the pistol grip handle; and a bale handle assembly engaged with the nozzle, the bale handle assembly comprising:

a bale handle; and a modular bale handle attachment removably engaged with the bale handle using an integral mechanical attachment, wherein the modular bale handle attachment comprises an inner surface that is complementary to a grip on an outer surface of the bale handle;

wherein the modular pistol grip attachment and the modular bale handle attachment are color-coded to indicate a particular characteristic associated with the handheld nozzle.

11. The handheld nozzle of claim 10, the modular pistol grip attachment and the modular bale handle attachment comprising material resilience to appropriately deform during attachment and to appropriately reform upon attachment.

12. The handheld nozzle of claim 10, the integral mechanical attachment of the modular pistol grip attachment comprising an integral connector that fits into a complementary recess in the pistol grip handle to facilitate alignment of the modular pistol grip attachment with the pistol grip handle, and to dispose the modular pistol grip attachment in a fixed engagement with the pistol grip handle.

13. The handheld nozzle of claim 10, the modular bale handle attachment comprising sidewalls, respectively comprising a lip, such that the sidewalls deflect outward during attachment to the modular bale handle attachment as a result of a shoulder of the bale handle driving the lips apart, resulting in the modular bale handle attachment disposed in a fixed engagement with the bale handle upon the lips of the sidewall clearing the shoulder of the bale handle.

14. The handheld nozzle of claim 13, the bale handle comprising a groove disposed along respective sides of the bale handle to receive the corresponding lip of the modular bale handle attachment, disposing the modular bale handle attachment in a fixed engagement with the bale handle.

15. The handheld nozzle of claim 10, the modular pistol grip attachment comprising a lip disposed at an end of respective sidewalls of the modular pistol grip attachment, the lip shaped to engage a recess disposed adjacent to a shoulder in the pistol grip handle to dispose the modular pistol grip attachment in a fixed engagement with the pistol grip handle.

16. A method of making a modular attachment system for a handheld firefighting nozzle, comprising:

forming a pistol grip module shaped for removable attachment to, and to cover at least a portion of, a pistol grip handle of the handheld nozzle, wherein the pistol grip module comprises an inner surface that is complementary to a grip on an outer surface of the pistol grip handle; and forming a bale handle module shaped for removable attachment to, and to cover at least a portion of, a bale handle of the handheld firefighting nozzle, wherein the bale handle module comprises an inner surface that is complementary to a grip on an outer surface of the bale handle;

wherein the pistol grip module and bale handle module are formed to engage with the pistol grip handle and the bale handle, respectively, using an integral mechanical attachment, and the pistol grip module and bale handle module are formed to respectively comprise a same color coding to visually indicate a particular characteristic associated with the handheld firefighting nozzle.

17. The method of claim 16, comprising one or more of:

forming of the pistol grip module with the integral mechanical attachment comprising forming an integral connector that fits into a complementary recess in the nozzle pistol grip to facilitate alignment of the pistol grip module with the nozzle pistol grip, and to dispose the pistol grip module in a fixed engagement with the nozzle pistol grip; and forming of the bale handle module with the integral mechanical attachment comprising forming an integral connector that fits into a complementary recess in the bale handle to facilitate alignment of the bale handle module with the bale handle, and to dispose the bale handle module in a fixed engagement with the bale handle.

* * * * *